US005810904A

United States Patent [19]

Holzgruber

[11] Patent Number: 5,810,904

[45] Date of Patent: Sep. 22, 1998

[54] PROCESS FOR PRODUCING BLOCKS OF METALS

[75] Inventor: Wolfgang W. Holzgruber, Westend, Austria

[73] Assignee: Inteco Internationale Technische Beratung Ges.m.b.H., Austria

[21] Appl. No.: 600,738

[22] Filed: Feb. 13, 1996

[30] Foreign Application Priority Data

Feb. 20, 1995 [DE] Germany ..... 195 05 743.0

[51] Int. Cl.[6] ..... C22C 19/00

[52] U.S. Cl. ..... 75/10.25; 164/470; 164/497

[58] Field of Search ..... 75/10.25; 373/51; 164/470, 497, 514, 515

[56] References Cited

U.S. PATENT DOCUMENTS 4,027,720 6/1977 Plockinger et al. ..... 75/10.25

FOREIGN PATENT DOCUMENTS 278693 5/1990 Germany ..... 373/51

*Primary Examiner*—Melvyn Andrews

[57] ABSTRACT

In a process for producing blocks of metals, in particular steels and nickel-base and cobalt-base alloys, by remelting self-consumable electrodes under electrically conductive slag in an atmosphere of controlled composition, the operation of melting down the self-consuming electrode is effected in a space which is gas-tightly delimited by the slag bath surface, the wall of a chill mold and a hood which is disposed on the chill mold, wherein for opening the closed-off space for effecting the electrode-change operation the gas-tight connection between the hood and the chill mold is separated, with the hood raised the residual electrode portion is removed from the melting region and a new electrode is moved into the melting position.

18 Claims, 3 Drawing Sheets

A
12
12a
13
14
16
16a
18
18a
18b
20
21
22
23
24
24a
25
26
28
30
32
34
x
a
b

PROCESS FOR PRODUCING BLOCKS OF METALS

The invention concerns a process for producing blocks of metals—in particular steels and nickel-base and cobalt-base alloys—by remelting self-consumable electrodes under electrically conductive slag in an atmosphere of controlled composition. The invention also concerns installations for carrying out the process.

For producing high-grade blocks which afford a good block structure and a high degree of purity, the so-called electro-slag remelting process has particularly proven its worth. At the time at which the process was introduced, comparatively simple installations were used, in which a single melting electrode was remelted in a water-cooled upright chill mold in air. In that case the block length which could be produced was restricted by the production length of the electrode. Installations of that kind were therefore generally operated at a high filling factor, that is to say a high relationship in respect of the cross-sectional area of the melting electrode with respect to the cross-sectional area of the water-cooled chill mold.

The advantage of that operating procedure was a simple arrangement of the installation but as a counterpart from that there was a series of disadvantages such as a low degree of flexibility, the high costs of the long upright crucible and in terms of electrode manufacture, as well as the great structural height for the blocks. A further disadvantage was the need to use high remelting current strengths because of the comparatively great filling factor, corresponding to a diameter relationship between electrode and chill mold of over 0.7.

The disadvantages referred to herein already resulted at an early date in the introduction of a series of different operating procedures with short chill molds and the possibility of remelting a plurality of electrodes in succession by application of the electrode-change technology. In that way it is possible to produce even long blocks involving block lengths of up to over 6 meters from a relatively large number of substantially shorter melting electrodes of lengths of about 2 meters, while there was also a free choice in terms of the filling factor.

The fact of being able freely to select the diameter relationship between the electrode and the chill mold over the entire technically possible and meaningful range of between 0.4 and 0.8 resulted in the possibility of producing blocks of larger diameter with a more favorable relationship of voltage to current strength than it had been possible to achieve with the upright crucible installations, because of the geometrical limitations thereof.

The mold costs were considerably reduced by virtue of the use of short chill molds either in the form of lifting molds or in the form of fixed molds in combination with downwardly movable base plates and, together with the electrode-change procedure, the flexibility of the installations was increased.

Installations are known which have lifting molds which are lifted at the average speed at which the block standing on the base plate grows, and two electrode carriages which are displaceable or pivotable in a horizontal direction and which can be fed in a vertical direction, with heavy-current terminals, by which the melting electrode is connected to the circuit and in which at one time the one electrode carriage and at another time the other electrode carriage are alternately in operation.

Instead of a lifting chill mold use is also made of short chill molds which are fixedly installed in a working platform, in combination with a downwardly movable base plate, in which case the base plate is moved downwardly on average at a speed which corresponds to the speed at which the block is formed. Those installations are again equipped either with two electrode carriages which are pivotable or displaceable in the horizontal direction, with heavy-current terminals, or they are equipped with electrode carriages which are only movable exclusively vertically with a current terminal, in combination with two pivotable auxiliary arms for loading and unloading the electrode and a residual electrode portion.

In all these alternative forms of installation the remelting operation is effected at atmospheric pressure, more or less in air, while occasionally the attempt may also be made to seal off the gap between the electrode and the chill mold by a cover and to introduce protective gas or dried air into the gap between the electrode and the chill mold. Those attempts, because of the irregular surface of the cast electrodes, naturally remain unsuccessful, the endeavours essentially being directed to preventing hydrogen absorption.

Besides the above-described alternative forms of installation and processes, there are also ESU-installations in which—in the same manner as in the case of the upright crucible installations—a block is produced from a single long melting electrode or an electrode bundle in an upright chill mold. It will be appreciated that those installations suffer from all the above-discussed disadvantages of electrode installations with upright chill molds, but they were tolerated as it was therewith possible for the first time to achieve the production on a large scale of large blocks of over 10 t in weight from steels with nitrogen contents of far above solubility at atmospheric pressure.

The steadily rising levels of requirement in terms of the properties of use of steels and alloys result in requirements for progressively lower contents of oxygen and non-metallic inclusions, in particular also in relation to remelted steels, so that performance of the electro-slag remelting operation under a satisfactorily controllable atmosphere is gaining in interest. In that respect, the aim is to be able to use any metallurgical possibility of forming an oxygen-free gas phase in the gap between the electrode and the chill mold. In particular, the aim is in that way to prevent the formation of scale at the hot electrode surface shortly before the electrode dips into the slag bath as, in the case of open smelting, that causes oxygen to be continuously transported into the slag bath and thus into the remelted metal.

In consideration of that state of the art the inventor set himself the aim of eliminating the deficiencies noted.

That object is attained by the teaching of the independent claim which provides a surprisingly simple and technically viable way of permitting electro-slag remelting when using short sliding chill molds and an electrode-change procedure under a controllable atmosphere at approximately atmospheric pressure. A particular embodiment even permits electro-slag remelting with a short sliding chill mold and electrode change under pressures in the space above the slag bath, which are considerably raised or lowered relatively to atmospheric pressure.

The appendant claims set forth desirable developments.

In accordance with the invention, in the electro-slag remelting operation under a controlled protective gas atmosphere at approximately atmospheric pressure in sliding crucibles using the electrode-change procedure, melting-down of the self-consumable electrode is effected in a space which is gas-tightly closed off and which is delimited by the slag bath surface, the wall of the water-cooled chill mold and the wall of a hood gas-tightly disposed on the water-cooled chill mold, a gas conduit for setting the atmosphere opening into the space; the hood includes a through-passage means in which a smooth electrode rod with clamping mechanism is displaceable through suitable sealing elements, for the supply of current. That closed-off space for effecting the electrode-change operation is opened by the gas-tight connection between a lower hood flange and a chill mold flange being separated, and by the hood—depending on the design configuration of the installation—being lifted to such an extent that the residual electrode portion is removed from the melting region and a new electrode can be moved into the melting position. After replacement of the electrode on the one hand the remelting operation is continued without delay and on the other hand the hood is immediately fitted again onto the chill mold flange and gas-tightly closed, and immediately thereafter the desired protective gas atmosphere is produced again in the closed-off space, by suitable measures.

The invention also embraces an embodiment in which the operation of remelting the self-consumable electrode takes place in the gas-tightly closed-off space under a pressure which is considerably lower than atmospheric pressure and which for example is below 500 mbar; the block is built up in a chamber in which the pressure obtaining is the same as the pressure in the space above the slag bath and wherein the pressure in the chambers, prior to the electrode-change operation, is firstly brought to atmospheric pressure before the gas-tight connection between the hood and the chill mold flanges is opened for carrying out the electrode-change operation.

In a further alternative form of the process according to the invention remelting of the self-consuming electrode in the gas-tightly closed space is effected under a pressure which is above atmospheric pressure, for example above 2.0 bars; in this case also the block is built up in a chamber in which the pressure obtaining is the same as the pressure in the space above the slag bath, and wherein during the electrode-change operation the pressure above the slag bath is maintained by a procedure whereby, after retraction of the residual electrode portion into the hood, firstly the space above the slag bath is closed off at the level of the chill mold flange by a gas-tight slider which is installed between the chill mold and the hood, then the pressure in the hood is reduced to atmospheric pressure, and it is only then that the gas-tight connection between the hood and slider flanges is opened for the purposes of carrying out the electrode-change operation. After removal of the residual electrode portion and the introduction of a fresh electrode into the melting position, firstly the hood is fitted onto the sealing flange and gas-tightly and pressure-tightly closed thereto, the pressure in the hood is set to the same value as the pressure above the slag bath, the gas-tight slider above the slag bath is opened and then the fresh electrode is lowered into the slag bath to continue with the remelting operation.

The fact that, in the electro-slag remelting procedure the liquid metal sump is covered over by a slag bath which prevents direct contact of the atmosphere with the surface of the liquid sump is helpful to the present invention. As already mentioned, in the procedure involving remelting in air, oxygen is introduced into the slag bath and further into the metal sump in particular for the reason that the melting electrode which dips into the superheated slag bath is heated immediately above the slag bath to high temperatures of over 1000° C. to 1200° C. so that this part of the electrode, in contact with the oxygen in the air, forms scale which is then carried into the slag bath in the further course of the procedure involving melting the electrode.

In order to prevent the formation of scale on the electrode surface which is heated above the slag—as the cause for possible oxygen absorption—it is necessary for the operation of melting down the electrode to be caused to take place in an oxygen-free atmosphere.

On the other hand, when the operation of melting down the electrode is interrupted, no oxygen is transferred into the metal sump as—as already stated—the latter is shielded from the atmosphere by the slag bath and direct transfer of oxygen cannot occur by way of the slag into a practically heavy metal ion-free slag which is under a high pressure. More specifically the slag can only transport oxygen if it contains heavy metal ions of alternate valency, such as for example ions of iron, manganese, chromium or the like.

As can be seen from the example of iron, only those ions can be oxidised at the slag-gas phase boundary—if the gas phase contains oxygen—in accordance with the following reaction:

$$2(FE^{2+})+\tfrac{1}{2}O_{2Gas} \leftrightarrow 2(FE^{3+})+(O^{2-})$$

whereby at the same time an additional oxygen ion is also absorbed into the slag. At the metal sump-slag phase boundary the trivalent iron is reduced again to bivalent iron, while at the same time oxygen is given off to the liquid metal, in accordance with the following reaction:

$$2(Fe^{3+})+(O^{2-}) \leftrightarrow 2(Fe^{2+})+[O]_{Metal}.$$

If the slag contains heavy metal ions of alternate valency therefore oxygen can be continuously transported from the gas phase by way of the slag bath into the metal bath. However, ESU-slags as are commercially available have an extremely low content of heavy metal oxide. It is only during the remelting operation due to the continuous introduction of scale that the heavy metal oxide content of the slags rises—in spite of continuing slag deoxidation—whereby the direct transfer of oxygen from the gas phase by way of the slag into the metal sump also comes into effect.

If therefore by suitable measures it is possible to prevent scale being formed at the electrode surface and thus to prevent oxygen ions from being introduced into the slag bath, an oxygen-bearing atmosphere above the slag bath can be tolerated during the short period of time of the electrode-change operation.

It is also to be emphasised that, in the electro-slag remelting procedure in sliding crucibles (lifting mold or short mold and downwardly movable base plate) the ambient atmosphere admittedly penetrates into the gap between the block surface and the mold wall, but does not there come into contact with the liquid metal; the metal immediately hardens upon contact with the water-cooled chill mold wall and thus—even if it experiences surface oxidation—is no longer in a position to transport the oxygen into the liquid metal sump.

Further advantages, features and details of the invention are apparent from the following description of two preferred embodiments—which are described in particular also in regard to carrying out the operating procedure of the method—and with reference to the drawing which shows in each case a diagrammatic vertical section of a protective-gas ESU-installation.

Figures 1, 2, 3:
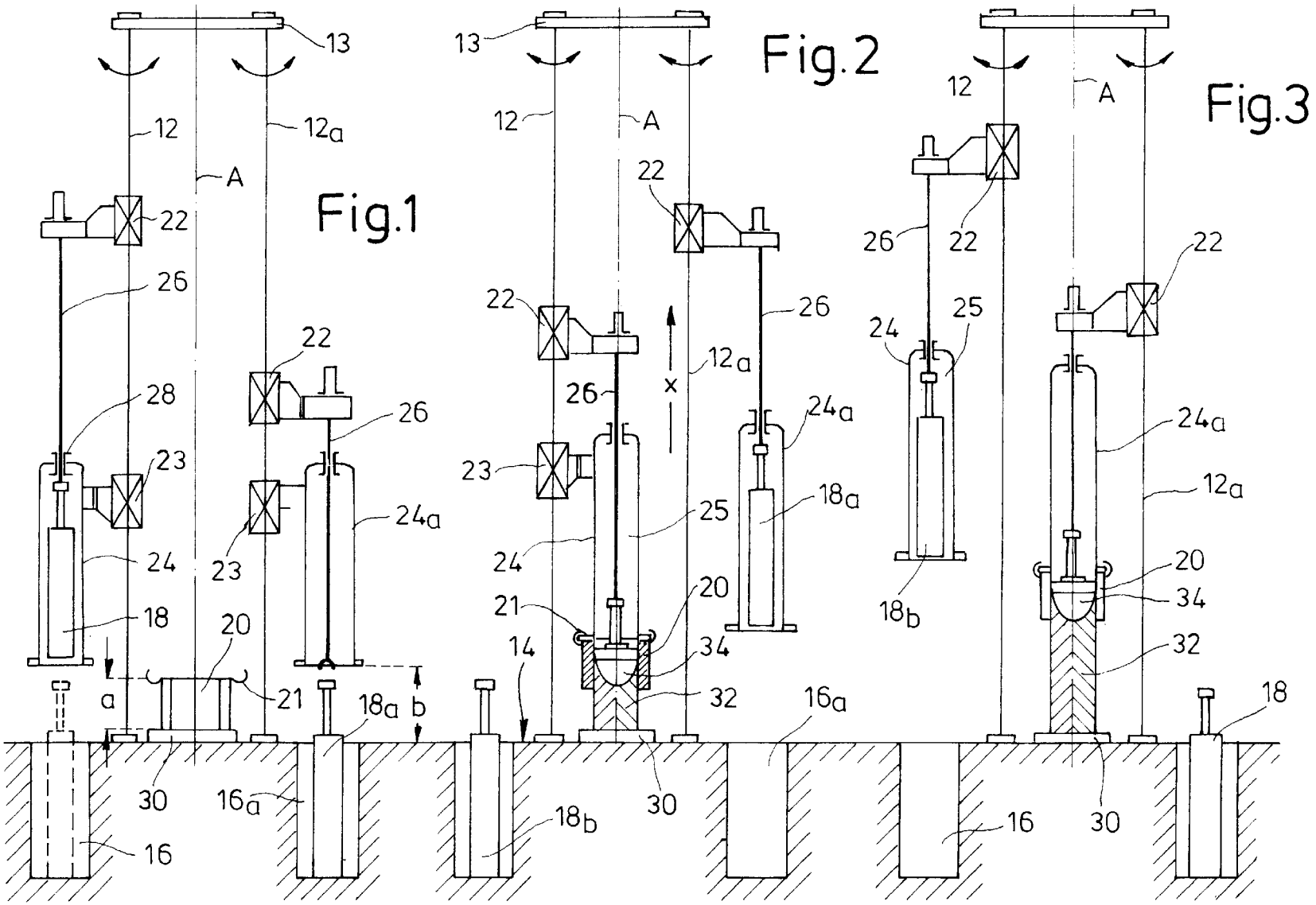
FIGS. 1 through 3 show an installation with a lifting mold and two pivotable process in different steps in the pillars and FIGS. 4 and 5 show another embodiment with a downwardly movable base plate and a fixed pillar in two different operating conditions.

Provided on both sides of the vertical axis A of a protective-gas ESU-installation 10 outside two pivotable columns or pillars 12, $\mathbf{12}_a$ in the locating platform 14 thereof are two electrode pits 16, $\mathbf{16}_a$ for electrodes 18, $\mathbf{18}_a$. A chill mold 20 of a height a can be seen on the vertical axis A between the pillars 12, $\mathbf{12}_a$ which are connected by a yoke 13. The mold 20 rests in FIG. 1 on the platform 14.

Arranged on each pillar 12 and $\mathbf{12}_a$ respectively in mutually superposed relationship are two carriages which are displaceable thereon and the upper one of which is identified as an electrode carriage 22 and the lower one of which is identified as a hood carriage 23. Fixed on the hood carriage 23 is a hood 24, $\mathbf{24}_a$ which extends coaxially with respect to an electrode 18, $\mathbf{18}_a$ which hangs on an electrode rod 26. The electrode rod 26 is fixed at one end to the electrode carriage 22 by a clamping terminal mechanism, by means of which the connection of a melting current to the electrode 18, $\mathbf{18}_a$ is made, wherein the electrode rod 26 is passed through a gas-tight axial through-passage means 28 into the interior 25 of the hood 24, $\mathbf{24}_a$ and is movable with the electrode carriage 22 relative to the pillar 12, $\mathbf{12}_a$.

The electrode rod 26 can move the electrode 18, $\mathbf{18}_a$ relative to the hood 24, $\mathbf{24}_a$. Thus the electrode $\mathbf{18}_a$ of the pillar $\mathbf{12}_a$ which is at the right in FIG. 1 rests for example in the electrode pit $\mathbf{16}_a$, that is to say beneath its hood $\mathbf{24}_a$ at a spacing b relative thereto.

After the chill mold 20 has been prepared for starting the procedure, the first electrode 18 is fixed in the clamping mechanism of its electrode rod 26 and moved into the hood 24 by upward movement of the electrode carriage 22. The hood 24 is now pivoted into a position over the chill mold 20 and fitted onto the chill mold flange 21 thereof, forming a gas-tight connection. After a suitable protective gas atmosphere has been adjusted, the electrode 18 is lowered by downward movement of the electrode carriage 22, until it is seated on a base plate 30 or a firing case or firing plate arranged there. The base plate can be disposed on a block carriage which is not shown and with which a finished ESU-block 32 can be moved out of the region of the installation.

The melting current is now switched on and after initial melting of the slag which is either disposed in the chill mold 2 or which is slowly added by way of a metering device (not shown), the remelting process is initiated. When that happens, to an extent corresponding to the difference between the speed at which the electrode melts away and the speed at which the block builds up, the electrode 18 is then progressively moved into a slag bath 34 which is formed.

Before the first electrode 18 is completely consumed, the second electrode $\mathbf{18}_a$ is clamped in the loading position to the second electrode rod 26 and introduced into the second hood $\mathbf{24}_a$, the latter already being moved into a position which permits it to be pivoted without risk into the melting position.

When the first electrode 18 is almost melted away, as shown in FIG. 2, at the same time the melting current is switched off, the residual portion of the electrode 18 is retracted into the hood 24, the hood/chill mold connection is opened, the hood 24 is raised slightly and then by pivotal movement of the pillar 12 it is pivoted out of the melting position into the loading/unloading position in which the residual electrode portion is removed.

As soon as the melting position is free the second pillar $\mathbf{12}_a$ is pivoted and thus the hood $\mathbf{24}_a$ with the second electrode 18*a* is moved over the melting position. Now at the same time on the one hand the hood $\mathbf{24}_a$ is moved downwardly and fitted onto the chill mold flange 21 and on the other hand the melting current is switched on; the electrode $\mathbf{18}_a$ is moved downwardly until it touches the slag bath surface and thus the remelting procedure continues. After the hood $\mathbf{24}_a$ has been fitted onto the chill mold flange 21 the atmosphere in the melting space which is now closed again is replaced without delay (FIG. 3).

After the second electrode $\mathbf{18}_a$ has been melted away the above-depicted procedure is repeated and a third electrode $\mathbf{18}_b$ is remelted, and that repetition is effected a number of times with further electrodes until the desired block length is reached.

When the method is performed in the above-described installation 10 with liftable chill mold 20, that affords the possibility of producing long ESU-blocks 32 from a plurality of comparatively short melt-down electrodes 18, $\mathbf{18}_a$, $\mathbf{18}_b$ in sliding crucibles under a controllable protective gas atmosphere.

Figure 4:
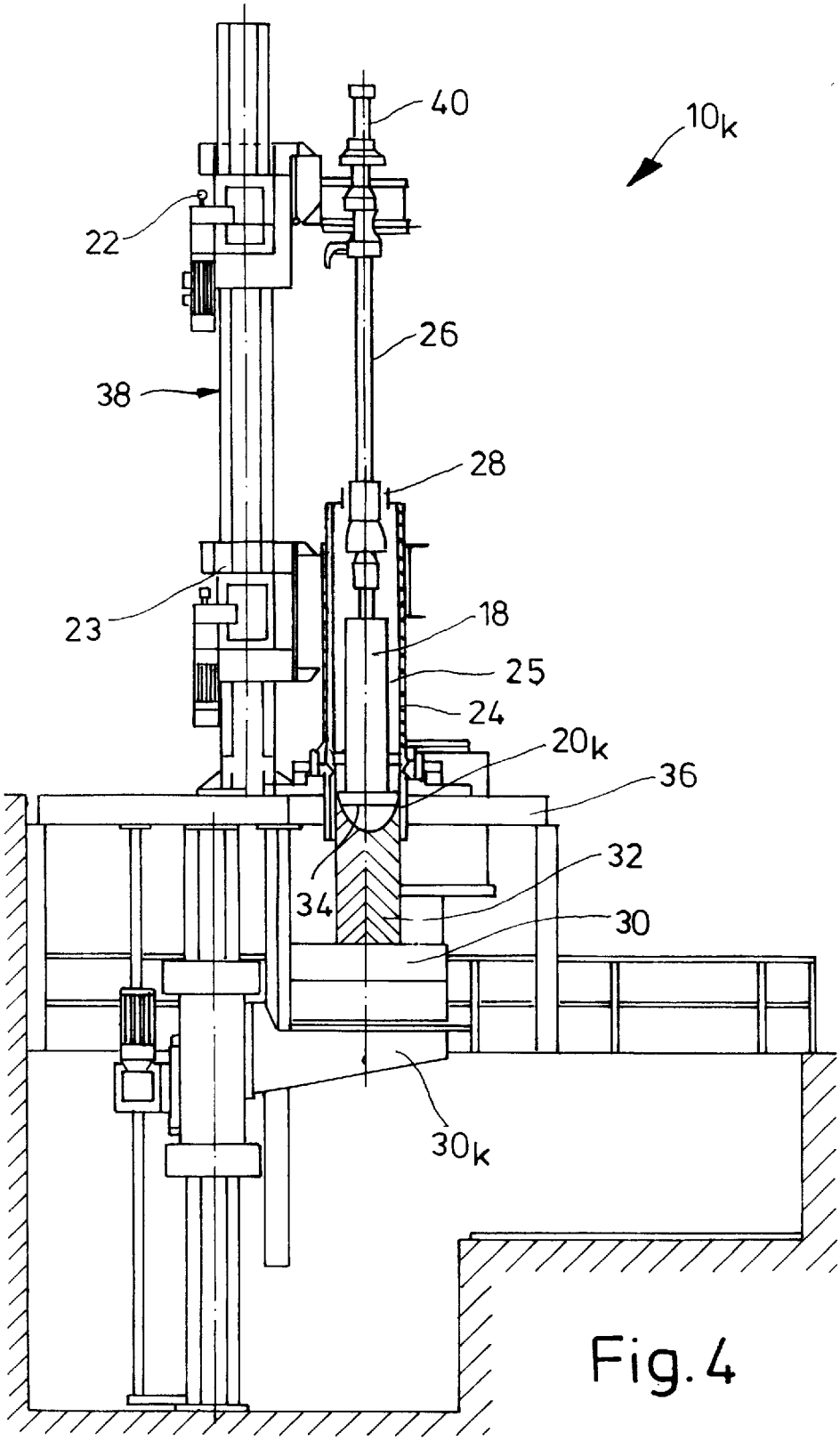
Figure 5:
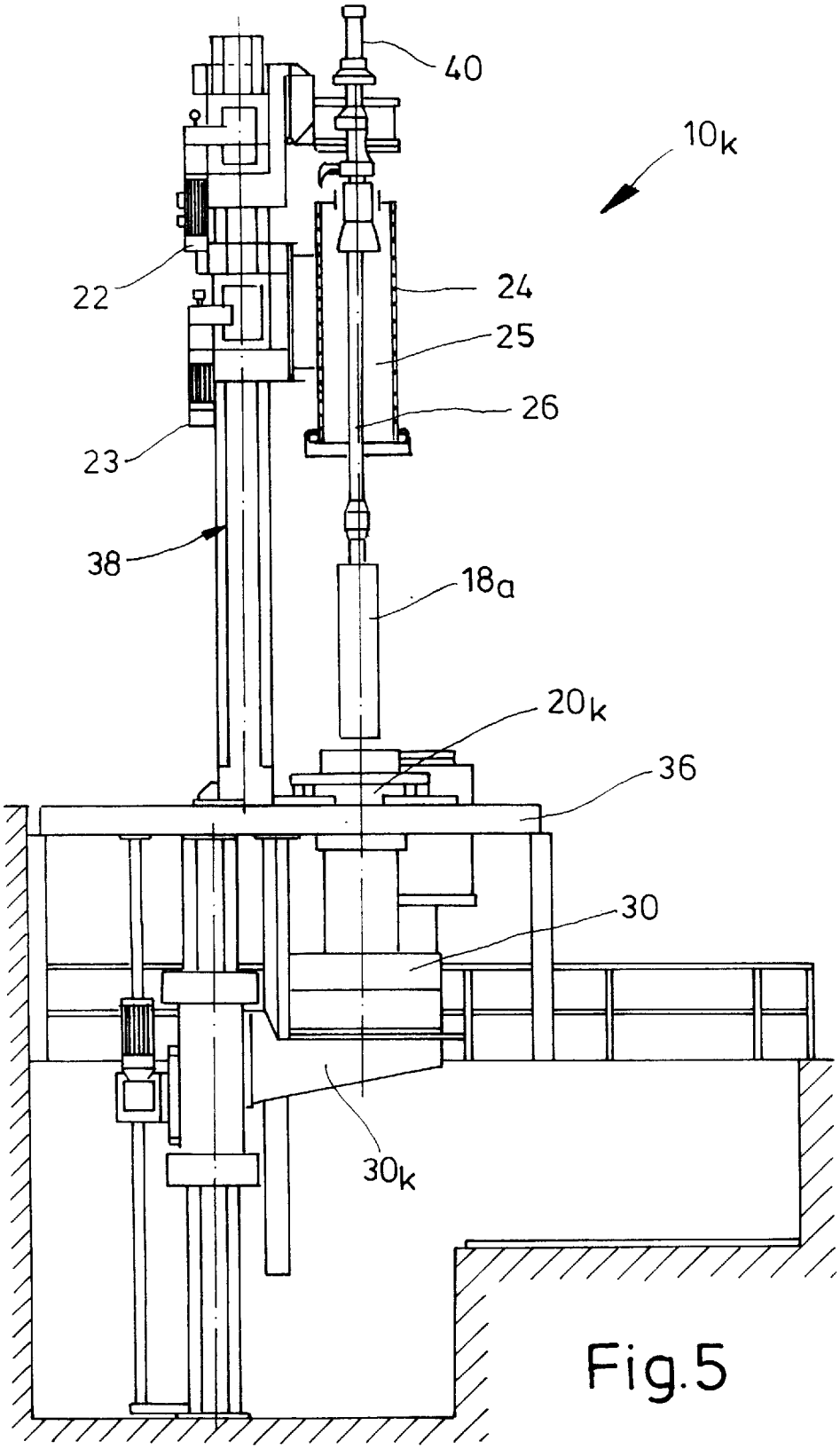

In another embodiment of an installation $\mathbf{10}_k$ as shown in FIGS. 4 and 5, which is suitable for carrying out the method, a short chill mold $\mathbf{20}_k$ is fixedly installed in a working platform 36 and the ESU-block 32 which is formed in the mold $\mathbf{20}_k$ is drawn downwardly by a downwardly movable base plate $\mathbf{30}_k$ at the same speed as corresponds to the speed at which the block is built up. That protective-gas ESU-installation $\mathbf{10}_k$ is provided with a fixed column or pillar 38 along which a hood carriage 23 and an electrode carriage 22 are movable in the vertical direction.

The electrode carriage 23 holds the electrode rod 26 with a clamping cylinder 40, by virtue of which the melting current is connected to the electrode 18; in this case also the electrode rod 26 is guided through a gas-tight through-passage means 28 into the interior of the hood 24.

For removal of the residual electrode portion from the melting position and for feed transportation of a new electrode $\mathbf{18}_a$ into the melting position, the installation has two pivotable auxiliary arms (not shown in the drawing) as loading and unloading arms.

After preparation of the chill mold $\mathbf{20}_k$ for starting the procedure the first electrode 18 is pivoted into the melting position, the electrode is received by the electrode clamp and clamped and the hood 24 and the electrode 18 are moved downwardly until on the one hand the latter is disposed on the downwardly movable base plate $\mathbf{30}_k$ or the firing plate and on the other hand the hood 24 is gas-tightly disposed on the mold flange 21.

After the desired atmosphere has been set the current is switched on and after initial melting of the slag has occurred the actual remelting operation is begun. During remelting of the first electrode 18 the second electrode $\mathbf{18}_a$ is prepared and suspended in the above-mentioned loading arm. When the first electrode 18 has melted away as far as a small disc portion, the melting current is switched off, the hood/chill mold connection is opened, and the hood 24 and the electrode rod 26 are moved into the change position. There, the unloading arm receives the residual electrode portion and pivots it out of the melting position. When the melting position is free, the new electrode $\mathbf{18}_a$ is pivoted into it by means of the loading arm, and is clamped by the electrode rod clamp. The loading arm is pivoted out, the melting current is switched on and the electrode $\mathbf{18}_a$ and the hood 24 are simultaneously lowered until on the one hand the electrode $\mathbf{18}_a$ touches the surface of the slag bath 34 and on the other hand the hood 24 gas-tightly fits on the mold flange 21. Subsequently thereto the protective gas atmosphere is produced again in the closed space above the slag. The remelting operation is now continued until the second electrode $18_a$ is also consumed. That electrode can now be changed again in the above-described manner. In that way a plurality of electrodes are remelted in succession until the desired block length has been reached.

The installation $10_k$ shown in FIGS. 4 and 5 with downwardly movable base plate $30_k$ may alternatively also be fitted with two pivotable pillars with a respective electrode and hood carriage. In that case the pivotable loading and unloading arms can be omitted.

The installation $10_k$ in FIGS. 4 and 5 with its downwardly movable base plate $30_k$, fixed pillar 38 and protective gas hood may also be designed in a relatively simple manner as a reduced-pressure and/or increased-pressure installation. In that case the base plate $30_k$ with the block 32 which is built up thereon is moved downwardly into a bottom vessel which is gas-tightly and pressure-tightly connected to the lower chill mold flange, in which case the pressures as between the hood 24 and the bottom vessel are equalised by way of a pressure equalisation conduit. In order to be able to maintain in particular an increased pressure above the slag bath 34 while the electrode-change operation is being performed, a shut-off slider member is preferably installed between the upper chill mold flange 21 and the hood flange, the slider member being closed before pressure relief of the hood 24. The shut-off slider member is only opened when, after having received the new electrode $18_a$, the hood 24 has been gas-tightly and pressure-tightly fitted in place and the equally high pressure has been set in the hood 24, as in the space above the slag bath 34.

I claim:

1. A process for producing blocks of a metal selected from a group consisting of steels, nickel-base alloys and cobalt-base alloys, by remelting self-consuming electrodes containing the selected metal one after the other under electrically conductive slag to form a slag bath within a chill mold as a melting region, said slag bath having a slag bath surface and said chill mold being closed by a hood, in a protective gas atmosphere of controlled composition, comprising the steps of:

(a) melting down one of the self-consuming electrodes in a space which is gas-tightly delimited by the slag bath surface, a wall of the chill mold and the hood which is disposed on the chill mold;

(b) separating a gas-tight connection between the hood and the chill mold by raising the hood to allow for effecting an electrode-change operation;

(c) removing a residual electrode portion from the melting region with the hood in a raised position, and moving a new electrode into the melting region within said chill mold;

(d) fitting the hood onto the chill mold and connecting the hood gas-tightly thereto after replacement of the electrode;

(e) reproducing thereupon the protective gas atmosphere under the closed hood;

(f) and continuing the aforesaid melting operation of step (a) until the new electrode is consumed; and (g) repeating the foregoing steps (a) through (f) until a required length of a block of metal, which is built up in the melting region, is reached.

2. The process of claim 1, further comprising the step of withdrawing said block of metal from the chill mold.

3. The process of claim 1, further comprising the step of moving said mold and said hood upwards as the ingot is built up on a baseplate, thereby providing free access to a solidified surface of the ingot.

4. The process of claim 1, further comprising the step of withdrawing said ingot from the mold.

5. The process of claim 1, wherein remelted ingot build up in the chill mold is stepwise removed therefrom to the open air by moving said mold and said hood upwards, thereby providing free access to a solidified surface of the ingot.

6. A process according to claim 1 in which after replacement of the electrode, the hood is fitted onto the chill mold and gas-tightly connected thereto and thereupon the protective gas atmosphere of controlled composition is reproduced under the closed hood and the remelting of self-consumable electrodes continues.

7. A process according to claim 1 in which the remelting of the self-consuming electrode is carried out in the gas-tightly closed-off space under a pressure which is much less than the atmospheric pressure;

building up a block in a space in which the pressure obtaining is the same as the pressure in the space above the slag bath, wherein the pressure in the spaces is brought to atmospheric pressure before the gas-tight connection between the hood and the chill mold is opened for the electrode-change operation.

8. A process according to claim 1 in which the remelting operation is carried out in the gas-tightly closed-off space at a pressure below 500 mbar.

9. A process according to claim 1, having a pressure in the remelting operation of below 200 mbar.

10. A process for producing blocks of a metal selected from a group consisting of steels, nickel-based alloys, and cobalt-based alloys, by remelting self-consuming electrodes containing the selected metal under electrically conductive slag to form a slag bath within a chill mold as a melting region, said slag bath having a slag bath surface and said chill mold being closed by a hood, in a protective gas atmosphere of controlled composition, comprising the steps of:

(a) melting down one of the self consuming electrode in a space which is gas-tightly delimited by the slag bath surface, the wall of the chill mold and the hood which is disposed on the chill mold, (b) melting the self-consuming electrode in the gas-tightly closed-off space under a pressure which is above atmospheric pressure;

(c) separating a gas-tight connection between the hood and the chill mold by raising the hood to allow for effecting an electrode-change operation;

(d) removing a residual electrode portion from a melting region with the hood in a raised position, and moving a new electrode into a melting position within said chill mold;

(e) fitting the hood onto the chill mold and connecting the hood gas-tightly thereto after replacement of the electrode;

(f) reproducing thereupon the protective gas atmosphere under the closed hood;

(g) and continuing the aforesaid melting operation of step (a) until the new electrode is consumed; and (h) repeating the foregoing steps (a) through (f) until a required length of a block of metal, which is built up in the melting region, is reached.

11. A process according to claim 10, further comprising the step of withdrawing said block of metal from the chill mold.

12. The process of claim 10, further comprising the step of moving said mold and said hood upwards as the ingot is built up on a baseplate, thereby providing free access to a solidified surface of the ingot.

13. The process of claim 10, further comprising the step of withdrawing said ingot from the mold.

14. The process of claim 10, wherein remelted ingot build up in the chill mold is stepwise removed therefrom to the open air by moving said mold and said hood upwards, thereby providing free access to a solidified surface of the ingot.

15. A process according to claim 10 in which after replacement of the electrode, the hood is fitted onto the chill mold and gas-tightly connected thereto and thereupon the protective gas atmosphere of controlled composition is reproduced under the closed hood and the remelting of self-consumable electrodes continues.

16. A process according to claim 10, wherein the block is built up in a space in which the pressure obtaining is the same as the pressure in the space above the slag bath, wherein the pressure above the slag bath is maintained during step (d) by a procedure wherein, after retraction of the residual electrode portion into the hood, firstly the space above the slag bath is closed off at the level of the chill mold region adjoining the hood by a gas-tight closure member disposed between the chill mold and the hood, then, reducing the pressure in the hood to atmospheric pressure and then opening the gas-tight connection between the hood and the closure member for replacement of the electrode.

17. A process according to claim 10 wherein the remelting operation is carried out in the gas-tight space at a pressure above 2.0 bars.

18. A process according to claim 17 wherein after removal of the electrode residual portion and the introduction of a new electrode into the melting position, the hood is fitted onto the closure member and gas-tightly and pressure-tightly closed thereto, the pressure in the hood is set to the value of the pressure above the slag bath, the gas-tight closure member above the slag bath is opened, and then the new electrode is lowered in the slag bath to continue the remelting procedure.

* * * * *